US007986909B2

(12) United States Patent
Nanba

(10) Patent No.: US 7,986,909 B2
(45) Date of Patent: Jul. 26, 2011

(54) FIXING DEVICE AND IMAGE FORMING APPARATUS USING THE SAME

(75) Inventor: Hitoshi Nanba, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1 day.

(21) Appl. No.: 12/559,045

(22) Filed: Sep. 14, 2009

(65) Prior Publication Data

US 2010/0239336 A1 Sep. 23, 2010

(30) Foreign Application Priority Data

Mar. 19, 2009 (JP) ..... P2009-067696

(51) Int. Cl.
*G03G 15/20* (2006.01)

(52) U.S. Cl. ..... 399/329

(58) Field of Classification Search ..... 399/67, 399/107, 110, 122, 320, 328, 329; 219/216, 219/619

See application file for complete search history.

(56) References Cited

U.S. PATENT DOCUMENTS

| | | | | |
|---|---|---|---|---|
| 5,300,999 | A * | 4/1994 | Koh et al. | 399/329 |
| 6,269,228 | B1 * | 7/2001 | Kayahara et al. | 399/37 |
| 2005/0185996 | A1 | 8/2005 | Oishi et al. | |
| 2009/0041515 | A1 * | 2/2009 | Kim | 399/324 |
| 2009/0208263 | A1 * | 8/2009 | Hanyu et al. | 399/329 |

FOREIGN PATENT DOCUMENTS

| | | |
|---|---|---|
| JP | 10-228196 | 8/1998 |
| JP | 11-219052 | 8/1999 |
| JP | 2001-228731 A | 8/2001 |
| JP | 2002-148985 A | 5/2002 |
| JP | 2004-198655 | 7/2004 |
| JP | 2004-325750 | 11/2004 |
| JP | 2005-275371 | 10/2005 |
| JP | 2008-76589 | 4/2008 |

* cited by examiner

*Primary Examiner* — Hoan Tran
(74) *Attorney, Agent, or Firm* — Morgan, Lewis & Bockius LLP

(57) ABSTRACT

A fixing device includes an endless belt member and a rotating body that are arranged to come in pressure contact with each other, the endless belt member and the rotating body having a source of heat generation; a pressing member that is arranged within the endless belt member and comes in pressure contact with the endless belt member to the rotating body; and a lubricant reservoir that is provided in the pressing member and reserves a semisolid or solid state lubricant, wherein a width in a central portion of the lubricant reservoir is wider than that in both ends of the lubricant reservoir, and widths along a length direction of the lubricant reservoir narrows from the central portion toward the both ends.

7 Claims, 7 Drawing Sheets

FIXING DEVICE AND IMAGE FORMING APPARATUS USING THE SAME

CROSS-REFERENCE TO RELATED APPLICATION

This application is based on and claims priority under 35 USC 119 from Japanese Patent Application No. 2009-067696 filed on Mar. 19, 2009.

BACKGROUND

Technical Field

The present invention relates to a fixing device and an image forming apparatus using the same.

SUMMARY

According to an aspect of the invention, a fixing device includes an endless belt member and a rotating body that are arranged to come in pressure contact with each other, at least one of the endless belt member and the rotating body having a source of heat generation; a pressing member that is arranged within the endless belt member and comes in pressure contact with the endless belt member to the rotating body; and a lubricant reservoir that is provided in the pressing member and reserves a semisolid or solid state lubricant so as to be supplied to a pressing portion of the pressing member coming in pressure contact with the rotating body through the endless belt member, wherein a width in a central portion of the lubricant reservoir is wider than that in both ends of the lubricant reservoir, and widths along a length direction of the lubricant reservoir narrows from the central portion toward the both ends.

BRIEF DESCRIPTION OF THE DRAWINGS

Exemplary embodiments of the invention will be described in detail based on the following figures, wherein.

DETAILED DESCRIPTION

Hereinafter, exemplary embodiments of the present invention will be described with reference to the drawings.

Exemplary Embodiment 1

Figure 2:
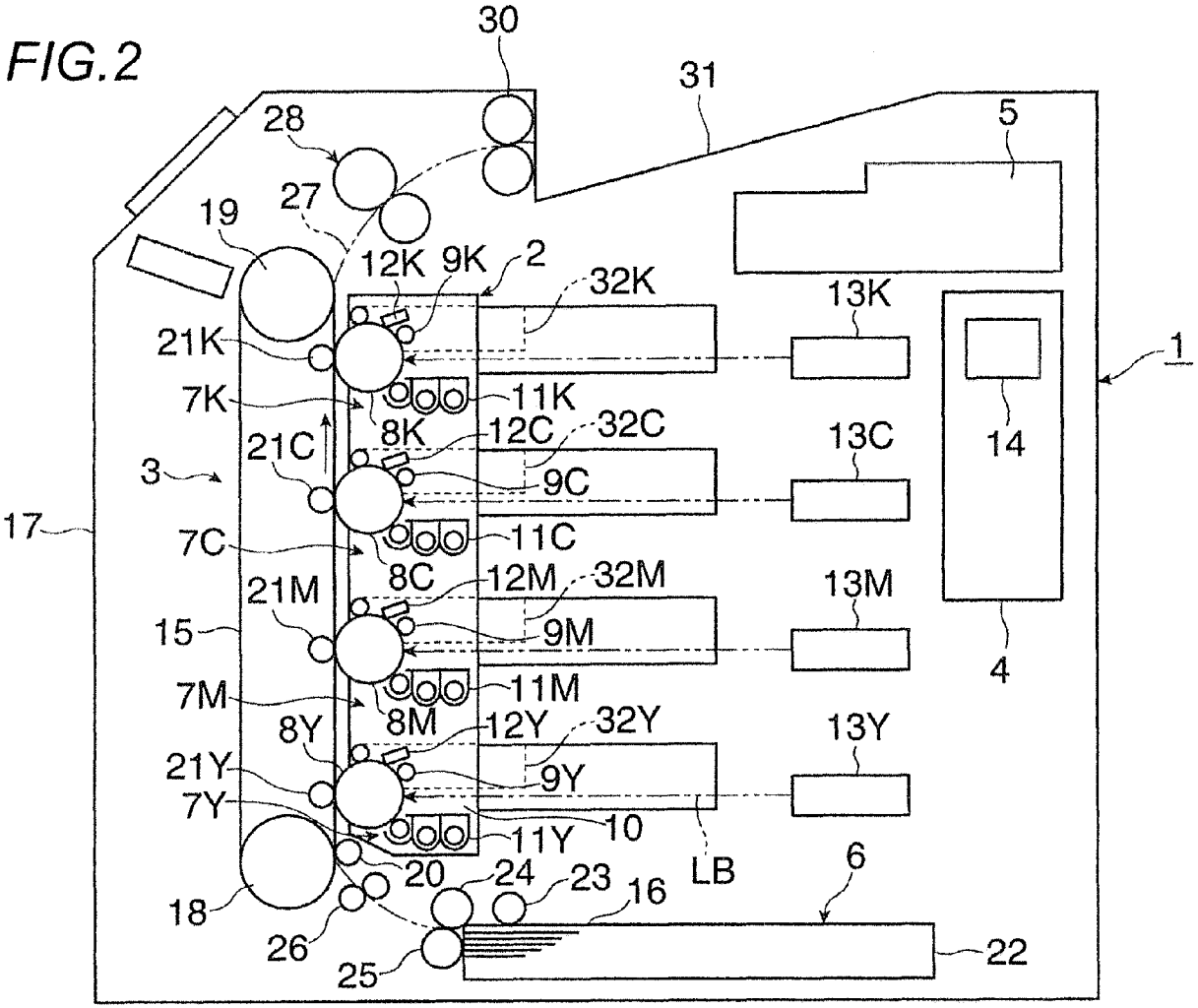
FIG. 2 is a configuration view showing a tandem type full color printer as an image forming apparatus to which the fixing device of Exemplary embodiment 1 of the present invention is applied.

FIG. 2 shows a tandem type full color printer as an image forming apparatus to which a fixing device of Exemplary embodiment 1 of the present invention is applied.

In FIG. 2, reference numeral 1 denotes a body of a tandem type full color printer as an image forming apparatus body. Within the printer body 1, an image forming unit 2 is vertically arranged in an approximate central portion of the body 1 along a vertical direction. In addition, within the full color print body 1, a sheet carrying belt unit 3 for carrying a recording medium on which a multi-colored toner image formed by the image forming unit 2 is transferred, with the recording medium absorbed on the sheet carrying belt unit 3, is arranged in one side of the image forming unit 2 (on the left side of the figure shown in this example), a control unit 4 including a control circuit and so on is arranged in the other side of the image forming unit 2 (on the right side of the figure shown in this example), and a power supply circuit unit 5 including a high voltage power supply circuit and so on is arranged on the right and upper side of the figure diagonal to the image forming unit 2. In addition, a sheet feeding device 6 for feeding recording sheets 16, or the like, as recording media is arranged on the lower side of the full color printer body 1.

The image forming unit 2 includes four image forming parts 7Y, 7M, 7C and 7K for forming toner images of various colors of yellow (Y), magenta (M), cyan (C) and black (K) in order from the bottom, and these four image forming parts 7Y, 7M, 7C and 7K are arranged in parallel at regular intervals along the vertical direction.

These four image forming parts 7Y, 7M, 7C and 7K have the same configuration except that they form images of different colors and each includes a photoconductive drum 8, as an image carrier, which is rotated at a predetermined rotation speed along a direction indicated by an arrow, a charging roll 9 for primarily charging a surface of the photoconductive drum 8 evenly, an image exposure passage 10 for forming an electrostatic latent image by performing an image exposure corresponding to each color for the surface of the photoconductive drum 8 by an image exposing device 13 which will be described later, a developing device 11 as developing means for developing the electrostatic latent image formed on the photoconductive drum 8 with toner of a corresponding color, and a cleaning device 12 for cleaning a transfer residual toner remaining on the photoconductive drum 8, as shown in FIG. 2.

As shown in FIG. 2, as described above, the control unit 4 is arranged within the full color printer body 1, and for example, an image processing device 14 for performing a predetermined image processing for image data is provided in the control unit 4. The image processing device 14 outputs image data of various colors, that is, yellow (Y), magenta (M), cyan (C) and black (K), to the image exposing devices 13Y, 13M, 13C and 13K in turn, and the photoconductive drums 8Y, 8M, 8C and 8K are scanned and exposed with four laser beams LB emitted from these image exposing devices 13Y, 13M, 13C and 13K according to the image data to form the electrostatic latent image. Electrostatic latent images formed on the photoconductive drums 8Y, 8M, 8C and 8K are developed as toner images of the colors of yellow (Y), magenta (M), cyan (C) and black (K) by the developing devices 11Y, 11M, 11C and 11K.

In addition, as shown in FIG. 2, the sheet carrying belt unit 3 includes a sheet carrying belt 15 which circularly moves without coming to an end as an endless belt, and the sheet carrying belt 15 is configured to carry a recording sheet 16 as a recording medium on which the toner images of various colors of yellow (Y), magenta (M), cyan (C) and black (K) formed by the image forming parts 7Y, 7M, 7C and 7K are transferred, with the recording sheet 16 and are electrostatically absorbed on the sheet carrying belt 15.

As shown in FIG. 2, the sheet carrying belt 15 is extended with a predetermined tension between a driving roll 18 and a driven roll 19, which are extension rolls arranged up and down along a vertical direction, and is configured to circularly move along a counterclockwise direction at a predetermined speed by the driving roll 18 rotatably driven by, for example, a driving motor (not shown) through a gear or the like. A distance between the driving roll 18 and the driven roll 19 is set to be approximately equal to a length of a short side of a recording sheet 37 of, for example, A4 size, but without being limited thereto, it is to be understood that the distance between the driving roll 18 and the driven roll 19 may be set at random. The sheet carrying belt 15 has an endless belt shape and is made of, for example, a flexible synthetic resin film such as polyimide or the like.

In addition, as shown in FIG. 2, an absorption roll 20 for electrostatically absorbing the recording sheet 16 on a surface of the sheet carrying belt 15 is arranged on a surface of the driving roll 18 such that the absorption roll 20 contacts the driving roll 18 through the sheet carrying belt 15. The absorption roll 20 is constructed by coating a surface of metal core with a conductive rubber, for example, like the charging rolls 9 of the image forming parts 7Y, 7M, 7C and 7K, and a predetermined bias voltage for absorption is applied to the metal core. The absorption roll 20 is configured to electrostatically charge the recording sheet 16 fed from the sheet feeding device 6 and absorb the charged recording sheet on the surface of the sheet carrying belt 15.

As shown in FIG. 2, the toner images of various colors of yellow (Y), magenta (M), cyan (C) and black (K) formed on the photoconductive drums 8Y, 8M, 8C and 8K of the image forming parts 7Y, 7M, 7C and 7K are multi-transferred onto the recording sheet 16 carried with it and absorbed on the surface of the sheet carrying belt 15, with the toner images overlapping with each other by the transfer rolls 21Y, 21M, 21C and 21K. The transfer rolls 21Y, 21M, 21C and 21K are integrally mounted on the sheet carrying belt unit 3.

As shown in FIG. 2, the recording sheet 16 is fed from the sheet feeding device 6 arranged on the lower side of the printer body 1. The sheet feeding device 6 has a sheet tray 22 in which the recording sheets 16 of desired size and material are accommodated. The recording sheets 16 of desired size and material are fed from the sheet tray 22 by a feed roll 23, with them separated one by one by a supply roll 24 and a separation roll 25, and are carried to an absorption position on the sheet carrying belt 15 at a predetermined timing through a resist roll 26.

Examples of the recording sheet 16 may include sheets of different materials, such as A4 size, A3 size, B5 size, B4 size sheets, a thick sheet such as an ordinary sheet and a coat sheet, an OHP sheet, and the like.

As shown in FIG. 2, the recording sheet 16 onto which toner images of various colors of yellow (Y), magenta (M), cyan (C) and black (K) are multi-transferred is separated from the sheet carrying belt 15 due to the hardness (so-called rigidity) of the recording sheet 16 and is carried to the fixing device 28 through a sheet carrying path 27, and then the toner images of the colors are fixed on the recording sheet 16 with heat and pressure by the fixing device 28. The sheet carrying belt 15 and the fixing device 27 are arranged to be closed to each other, and the recording sheet 16 separated from the fixing device 28 is carried to the fixing device 28 by a carrying force of the sheet carrying belt 15. Thereafter, the recording sheet 16 on which the toner images of the colors are fixed is discharged to a discharge tray 31, which is provided in the upper side of the full color printer body 1, by a discharge roll 30, with a printed surface of the recording sheet facing downward, and then the printing operation is ended.

In addition, after the image forming operation is ended, a transfer residual toner is removed from the surface of the photoconductive drum 8Y, 8M, 8C and 8K by the cleaning device 12 for preparation for a next image forming process.

In addition, the full color printer can print an image of desired color such as monochrome, without being limited to the full color image, and accordingly, toner images are formed by the image forming parts 7Y, 7M, 7C and 7K of all or some of yellow (Y), magenta (M), cyan (C) and black (K) depending on the color of an image to be printed.

The fixing device according to this exemplary embodiment includes:

an endless belt member and a rotating body arranged to come in pressure contact with each other, at least one of the endless belt member and the rotating body having a source of heat generation, pressing member which is arranged within the endless belt member and comes in pressure contact with the endless belt member to the rotating body, and a lubricant reservoir which is provided in the pressing member, reserves a semisolid or solid state lubricant to be supplied to a pressing portion of the pressing member coming in pressure contact with the rotating body through the endless belt member.

Figure 3:
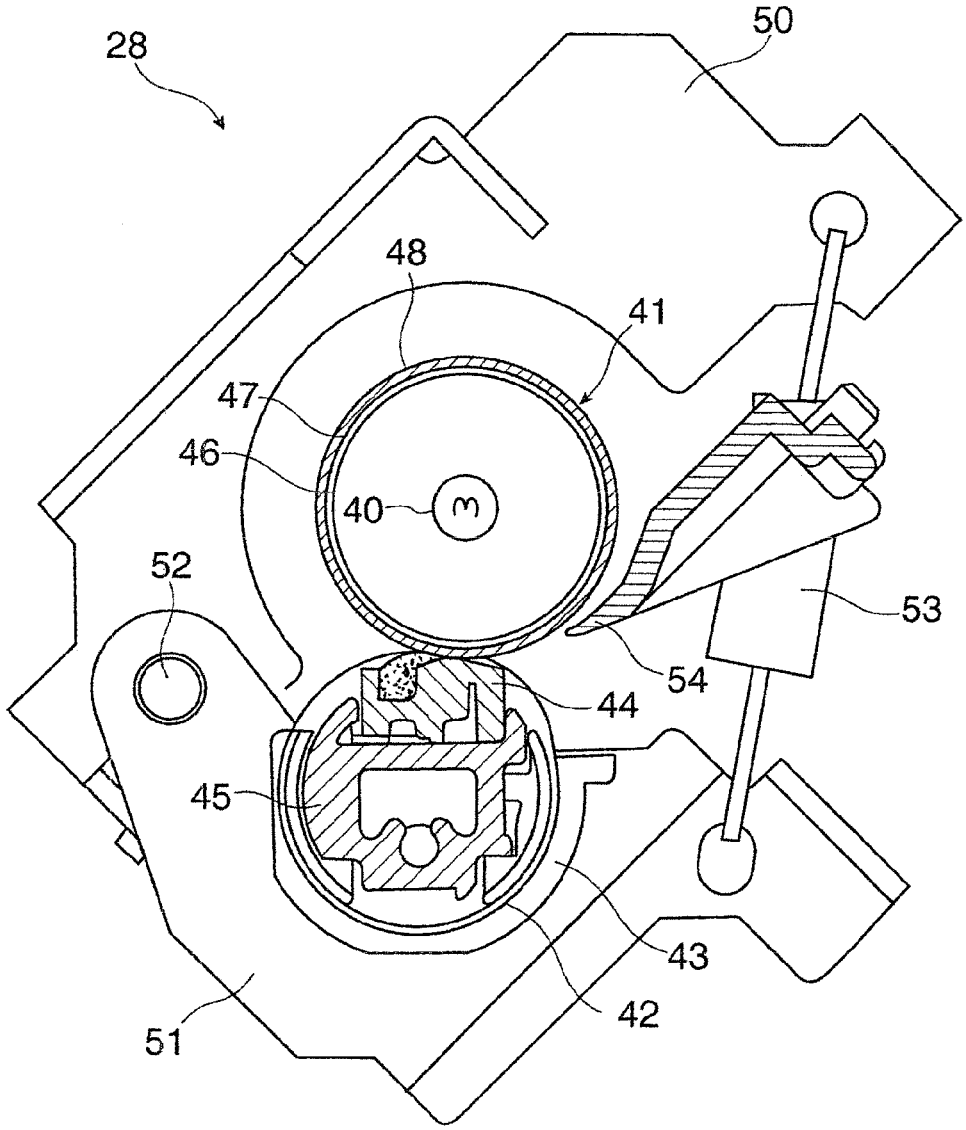
FIG. 3 is a sectional configuration view showing a fixing device.

FIG. 3 is a sectional view showing a fixing device used for the full color printer according to this exemplary embodiment.

A shown in FIG. 3, a fixing device 28 according to this exemplary embodiment includes a heat roll 41 as a rotating member having a heating source 40, a fixing belt 42 as an endless belt member, a belt support member 43 which supports both ends of the fixing belt 42 such that the fixing belt 42 is freely rotated, a pressing member 44 which is arranged in the fixing belt 42 and comes in pressure contact with the fixing belt 42 to a surface of the heat roll 41, and a holding member 45 which holds the pressing member 44.

The heat roll 41 includes a thin cylindrical core 46 made of iron, stainless steel, aluminum or the like, an elastic layer 47 made of silicon rubber or the like coated on a surface of the core 46 and having a thickness of 0.65 mm or so, and a releasing layer 48 made of PFA or the like coated on a surface of the elastic layer 47 and having a thickness of 30 μm or so. In addition, for example, a halogen lamp 40 of 650 W as the heating source is arranged in the inside (center) of the heat roll 42.

In addition, the fixing belt 42 has a cylindrical endless belt shape formed of a synthetic resin such as polyimide or the like and having an outer diameter of 30 mm and a thickness of 75 μm, and if necessary, is provided thereon with a releasing layer (not shown) made of PFA or the like.

As shown in FIG. 3, the heat roll 41 is rotatably mounted on an upper frame 50 provided in both ends of the fixing device 28 through a bearing member (not shown). The belt support member 43 is fixedly mounted on a lower frame 51 provided in both ends of the fixing device 28. The upper frame 50 and the lower frame 51 are loosely interconnected around a support axis 52 and come in pressure contact with a surface of the heat roll 41 by a compression spring 53 spanning across an end opposite to the support axis 52, with the fixing belt 24 pressed against the surface of the heat roll 41 by the pressing member 44.

In FIG. 3, reference numeral 54 denotes a peeling member which peels a recording sheet from the surface of the heat roll 41.

Figure 4:
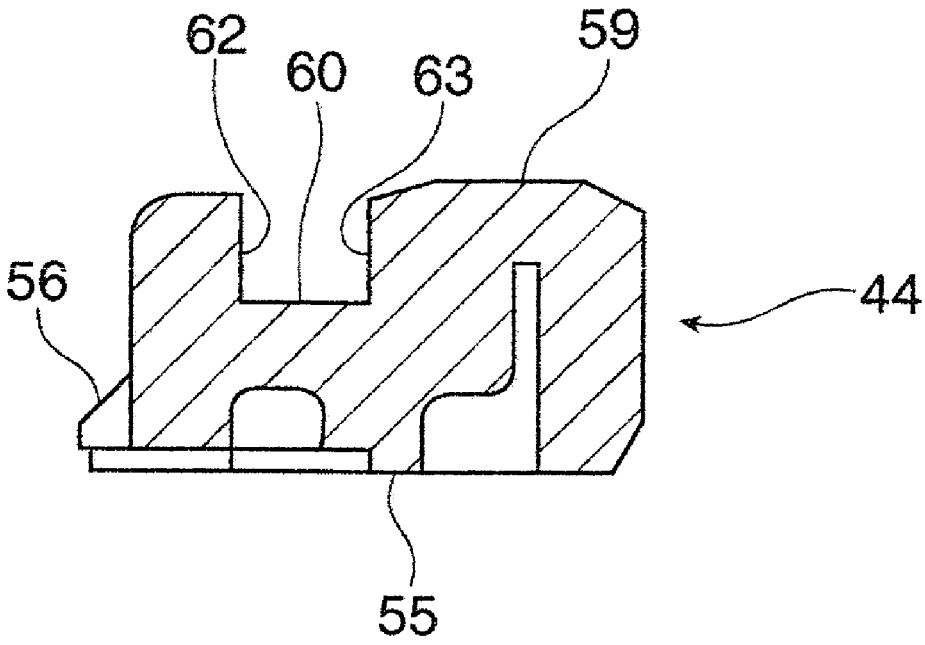
FIG. 4 is a sectional configuration view showing a pressing member.

As shown in FIG. 4, the pressing member 44 made of, for example, synthetic resin such as liquid crystal polymer resin (LCP) or the like, or metal such as aluminum or the like and having an approximately rectangular section shape formed such that the heat roll 41 side has a predetermined recessed shape. A bottom 55 of the pressing member 44 is formed to be flat and a projection 56 having an approximately triangular section shape is provided in a bottom of one side of the pressing member 44 positioned at an upstream side of the rotation direction of the fixing belt 42. As shown in FIG. 3, when the pressing member 44 is mounted in a concave portion 57 of the holding member 45, the projection 56 is fitted into an angled portion 58 of the concave portion 57.

On the top of the pressing member 44 a contact portion 59 is provided which comes in pressure contact with the heat roll 41 at a downstream side of the rotation direction of the fixing belt 42. The contact portion 59 is formed to be higher by a predetermined minute height than the other top of the pressing member 44, and as shown in FIG. 5, the width W2 of both of its ends which tend to increase a nip pressure are set be narrow, while the width W1 of its central portion which tends to decrease the nip pressure is set to be wide such that the nip pressure becomes substantially uniform along a length direction of the pressing member 44.

In addition, the contact portion 59 of the pressing member 44 has minute unevennesses constantly formed by performing a roughening process in order to reduce a sliding resistance between the contact portion 59 and the fixing belt 42 by reducing a contact area with the inner side of the fixing belt 42. A surface roughness of the contact portion 59 of the pressing member 44 is set to be a predetermined value.

In addition, a lubricant reservoir 60 is provided on the top of the pressing member 44, which reserves a grease 61 as a semisolid or solid state lubricant to be supplied to the contact portion 59 of the pressing member 44, at an upstream side of the contact portion 59 in the rotation direction of the fixing belt 42 across the entire length of the pressing member 44 along the length direction of the pressing member 44. As shown in FIG. 4, the lubricant reservoir 60 is formed to have a concave portion having a predetermined depth. However, a side wall 63 at a downstream side of the rotation direction of the fixing belt 42 is set to be slightly higher than a side wall 62 at an upstream side of the rotation direction so that the amount of the supply of grease can be set to be approximately uniform along the length direction of the lubricant reservoir 60. The grease 61 circulated while being attached to the inner side of the fixing belt 42 can be recovered and again supplied. The side wall 63 at the downstream side of the rotation direction is formed to have a recessed shape such that the central portion of the pressing member 44 along its length direction is positioned at a downstream side and both its ends are positioned to an upstream side.

Figure 5A:
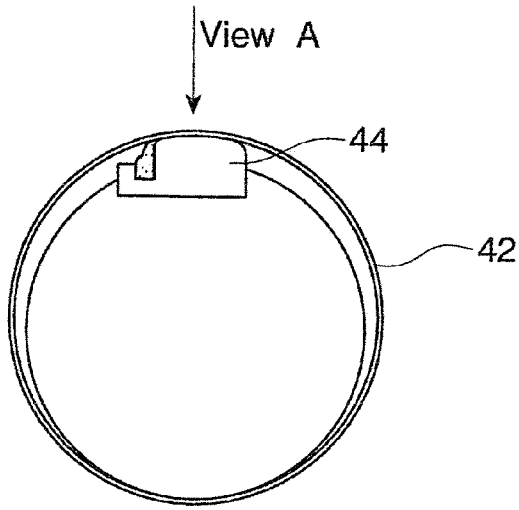
FIG. 5 is a configuration view showing a main portion of a fixing device.
Figure 5B:
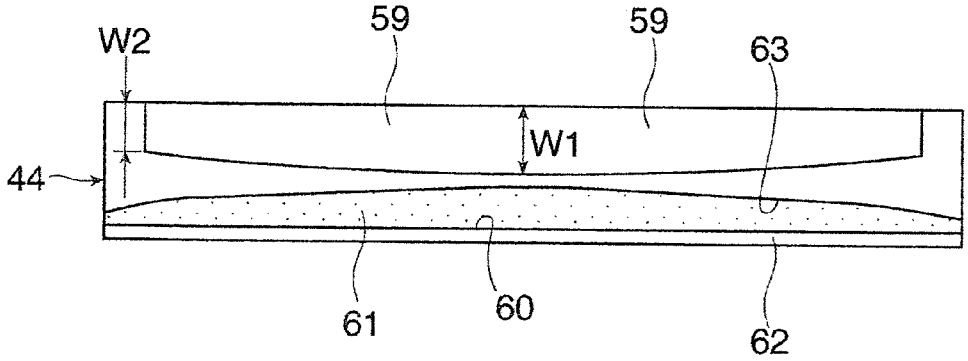
Figure 6:
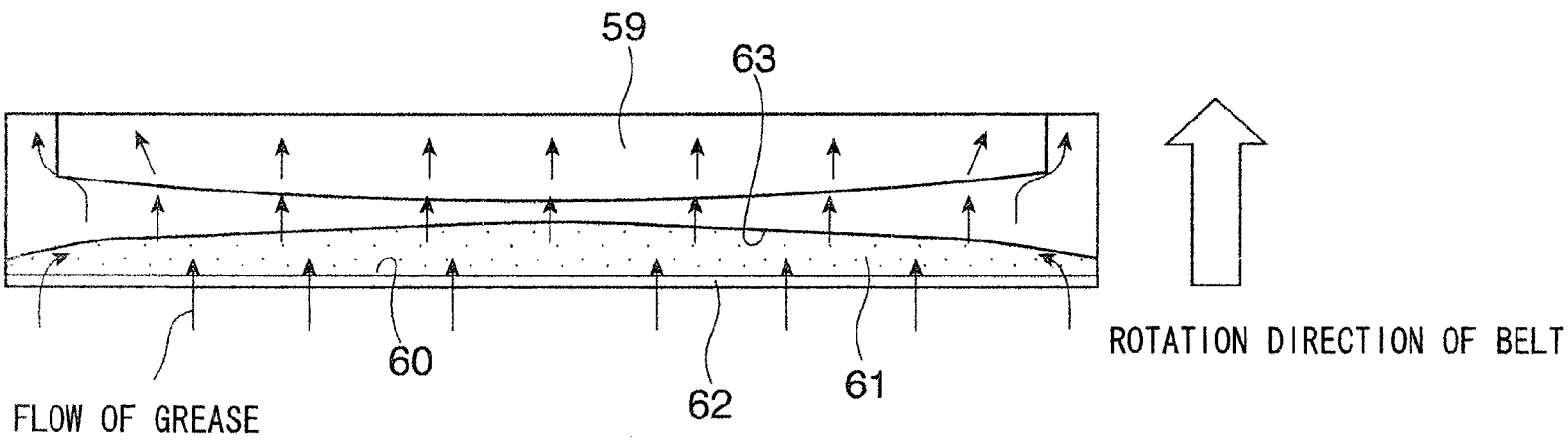
FIG. 6 is a schematic view showing a flow of lubricant.

In addition, as shown in FIG. 5(*b*), both ends of the lubricant reservoir 60 in its length direction have their opened section. The grease 61 circulated with it attached to the inner side of the fixing belt 42 is supplied to spread, from the central portion, both ends of the lubricant reservoir 60 in its length direction due to a mobility property of the grease 61 having high viscosity and the recessed shape of the side wall 63 positioned at the downstream side of the rotation direction of the fixing belt 42. The grease 61 is recovered to the central portion of the lubricant reservoir 60 in its length direction by the recessed shape of the side wall 63.

The grease 61 as the lubricant is a lubricating oil added with a thickening agent and has viscosity higher than a lubricating oil, maintenance in the lubricant reservoir 60 and the ability to supply a minute amount long term, that is, supply stability. Among others, the grease 61 may be a fluorine-based grease such as Krytox (trade mark) or the like from the viewpoint of excellent heat resistance. Alternatively, the grease 61 may also be a conductive grease with an added conducting agent. By the fixing belt 42 or the pressing member 44 given with conductivity by using the conductive grease, it is possible to prevent an electrostatic offset when toner remains in the contact portion due to friction charging or the like.

Figure 7:
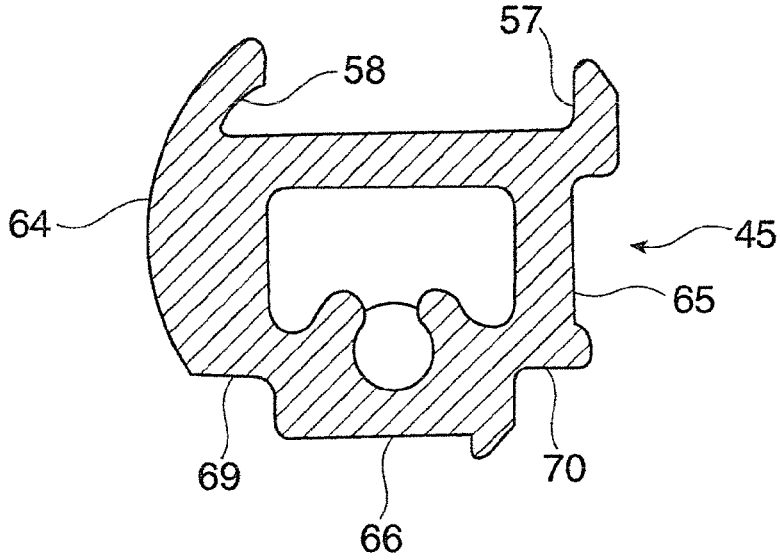
FIG. 7 is a sectional configuration view showing a holding member.

In addition, as shown in FIG. 7, the holding member 45 is made of synthetic resin or the like and has an approximately rectangular section with its one side 64 formed with a circular arc. The holding member 45 is provided with a concave portion 57 for mounting the pressing member 44 with it inserted in the end of the heat roll 42. In addition, mounting portions 65 and 66 for mounting the belt support member 43 are provided in the side and bottom of the downstream side of the holding member in the rotation direction of the fixing belt 42 of the holding member 45, respectively. The mounting portion 65 positioned at the downstream side of the holding member 45 in the rotation direction of the fixing belt 42 has a plane to contact a convex portion 67 of the belt support member 43. The mounting portion 66 positioned at the bottom of the holding member 45 has a convex portion fitted into a concave portion 68 of the belt support member 43. End portions 69 and 70 positioned at the left and right sides of the convex portion 66, respectively, have surfaces contacting convex portions 71 and 72 provided in the left and right sides of the concave portion 68 of the belt support member 43.

Figure 8:
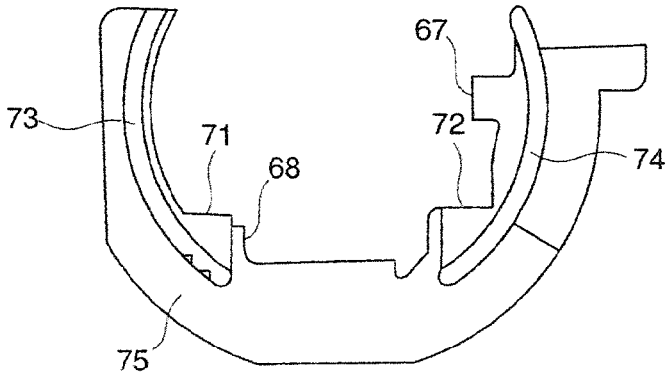
FIG. 8 is a side configuration view showing a belt support member.

In addition, as shown in FIG. 8, the belt support member 43 is mounted with it fitted into both ends of the above-configured holding member 45 in its length direction, holds the fixing belt and regulates movement along an axial direction of the fixing belt 42. The belt support member 43 is provided at the upstream and downstream sides of the nip portion in the rotation direction of the fixing belt 42 and is provided with first and second circular arcs 73 and 74 for guiding the fixing belt 42. In addition, in the belt support member 43, a flange portion 75 for regulating both ends of the fixing belt 42 in its length direction is provided in a region except for the upstream and downstream sides of the nip portion.

In a printer using the above configured fixing device according to this exemplary embodiment, for the fixing device for performing a fixing process by coming in pressure contact with the endless belt and the rotating member with each other as follows, it is possible to achieve a smooth rotation of the endless belt as well as a reduction in the number of parts and production costs.

Figure 1:
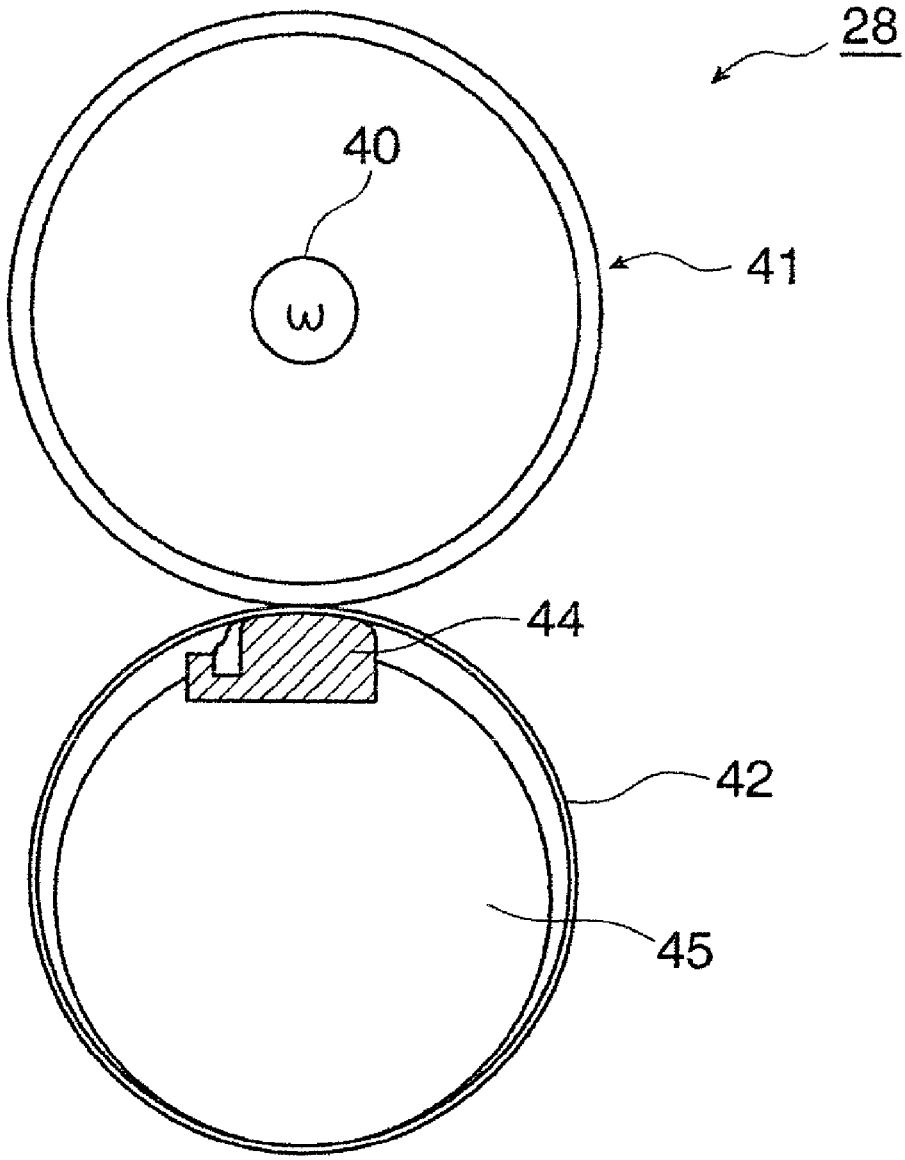
FIG. 1 is a schematic configuration view showing a main portion of a fixing device according to Exemplary embodiment 1 of the present invention.

Specifically, as shown in FIG. 1, in the fixing device 28 according to this exemplary embodiment, since the pressing member 45 for pressing the fixing belt 42 against the heat roll 41 has the lubricant reservoir 60 for reserving the grease 61 as the lubricant and directly supplies the grease 61 as the lubricant from the lubricant reservoir 60 to the contact portion between the pressing member 44 and the fixing belt 42, it is possible to reduce the number of parts of the fixing device 28 for significant simplification of its structure, which results in a reduced cost of the apparatus, without requiring members such as a special sheet member for friction reduction to reduce sliding resistance between the fixing belt and the pressing member and a felt for applying oil to the inner side of the fixing belt 42 as in the related fixing devices.

In addition, since the grease 61 as the lubricant reserved in the lubricant reservoir 60 can be stably supplied a minute amount to the contact portion between the pressing member 44 and the fixing belt 42 long term with the viscosity of the grease 61 lowered by heat from the heat roll 41, it is possible to reduce the sliding resistance between the pressing member 44 and the fixing belt 42, which results in a stable rotation of the fixing belt 42 and prevents the occurrence of sheet creases and the like.

Although a combination of the heat roll and the fixing belt has been illustrated in this exemplary embodiment, the present invention is not limited to this exemplary embodiment but it is to be understood that a heating side has an endless belt member and another rotating member is constituted by a fixing roll of a pressuring side. In this case, the endless belt member itself may generate heat or a heating portion may be provided in the pressing member for pressing the endless belt member against the fixing roll. In addition, in this case, the lubricant reservoir is provided at the upstream side in a belt movement direction of the heating portion of the pressing member.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A fixing device comprising:

an endless belt member and a rotating body that are arranged to come in pressure contact with each other, at least one of the endless belt member and the rotating body having a source of heat generation;

a pressing member that is arranged within the endless belt member and comes in pressure contact with the endless belt member to the rotating body; and a lubricant reservoir that is provided in the pressing member and reserves a semisolid or solid state lubricant so as to be supplied to a pressing portion of the pressing member coming in pressure contact with the rotating body through the endless belt member, wherein a width in a central portion of the lubricant reservoir is wider than that in both ends of the lubricant reservoir, and widths along a length direction of the lubricant reservoir narrows from the central portion toward the both ends.

2. The fixing device according to claim 1, wherein the rotating body is a heat roll and the endless belt member is a fixing belt.

3. The fixing device according to claim 1, wherein the lubricant is a conductive grease.

4. The fixing device according to claim 1, wherein the pressing portion of the pressing member coming in pressure contact with through the endless belt member is roughened.

5. The fixing device according to claim 1, wherein the lubricant is supplied to spread, from the central portion, both ends of the lubricant reservoir in the length direction due to a recessed shape of a first side wall of the pressing member at a downstream side in a rotation direction of the endless belt member.

6. The fixing device according to claim 1, wherein a first side wall of the pressing member at a downstream side in a rotation direction of the endless belt member is slightly higher than a second side wall of the pressing member at an upstream side in the rotation direction of the endless belt member, wherein the lubricant circulated while being attached to the inner side of the endless belt member is recovered and again supplied after being supplied to the pressing portion of the pressing member coming in pressure contact with the rotating body through the endless belt member.

7. An image forming apparatus comprising:

an image carrier on which a toner image based on image information is formed;

a recording medium onto which the toner image formed on the image carrier is transferred directly or via an intermediate transfer body; and a fixing device according to claim 1 as fixing means for fixing an unfixed toner image transferred onto the recording medium.

* * * * *